US008555677B2

(12) United States Patent
Hendrickson et al.

(10) Patent No.: US 8,555,677 B2
(45) Date of Patent: Oct. 15, 2013

(54) APPARATUS AND METHOD FOR CONTROLLING BULK DISPENSING OF WASH AID BY SENSING WASH AID CONCENTRATION

(75) Inventors: Michael Stephen Hendrickson, Saint Joseph, MI (US); Dennis L. Kehl, Benton Harbor, MI (US); Ayomide Fawole, Chicago, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/587,196

(22) Filed: Aug. 16, 2012

(65) Prior Publication Data

US 2012/0304706 A1 Dec. 6, 2012

Related U.S. Application Data

(62) Division of application No. 12/194,671, filed on Aug. 20, 2008, now Pat. No. 8,266,748.

(60) Provisional application No. 61/077,402, filed on Jul. 1, 2008.

(51) Int. Cl.
*D06F 39/02* (2006.01)
*D06F 33/02* (2006.01)

(52) U.S. Cl.
USPC ..... 68/12.18; 68/17 R; 68/207

(58) Field of Classification Search
USPC ..... 68/12.02, 17 R, 207, 12.18
See application file for complete search history.

(56) References Cited

U.S. PATENT DOCUMENTS

| | | | | |
|---|---|---|---|---|
| 4,858,449 | A * | 8/1989 | Lehn | 68/12.18 |
| 8,113,236 | B2 * | 2/2012 | Kandiyeli et al. | 137/563 |
| 2005/0263173 | A1 * | 12/2005 | Luckman et al. | 134/42 |
| 2006/0206238 | A1 * | 9/2006 | Walker et al. | 700/283 |

FOREIGN PATENT DOCUMENTS

DE 3403622 A1 * 8/1985

OTHER PUBLICATIONS

Machine translation of DE 3403622 A1, no date.*

* cited by examiner

*Primary Examiner* — Joseph L Perrin
(74) *Attorney, Agent, or Firm* — Clifton G. Green; McGarry Bair PC

(57) ABSTRACT

A treatment aid dispensing apparatus for an automatic treatment appliance includes a bulk treatment aid dispenser, a sensor coupled with the bulk treatment aid dispenser, and a controller coupled with the sensor and the bulk treatment aid dispenser. A quantity of an undiluted treatment aid can be determined by the controller prior to dispensing from the bulk treatment aid dispenser based upon information from the sensor indicative of a sensed concentration of the undiluted treatment aid. The controller can process the information from the sensor and control the operation of the bulk treatment aid dispenser.

11 Claims, 6 Drawing Sheets

| Detergent | Class | Surfactant % | Refractive Index |
|---|---|---|---|
| Example 1 | 1X | 4.0 | 1.305500 |
| Example 2 | 1X | 12.0 | 1.307850 |
| Example 3 | 1X | 12.6 | 1.310960 |
| Example 4 | 1X | 14.7 | 1.310640 |
| Example 5 | 1X | 14.9 | 1.314700 |
| Example 6 | 1X | 15.5 | 1.309800 |
| Example 7 | 3X | 40.8 | 1.334500 |
| Example 8 | 3X | 46.2 | 1.359050 |

Fig. 3

APPARATUS AND METHOD FOR CONTROLLING BULK DISPENSING OF WASH AID BY SENSING WASH AID CONCENTRATION

CROSS-REFERENCE TO RELATED APPLICATION

The present invention is a divisional application of U.S. patent application Ser. No. 12/194,671 entitled "Apparatus And Method For Controlling Bulk Dispensing Of Wash Aid By Sensing Wash Aid Concentration", filed Aug. 20, 2008, now U.S. Pat. No. 8,266,748 to Hendrickson et al., issued Sep. 18, 2012, which patent claims the benefit of U.S. Provisional Patent Application Ser. No. 61/077,402 entitled "Apparatus And Method For Controlling Bulk Dispensing Of Wash Aid By Sensing Wash Aid Concentration", filed Jul. 1, 2008.

BACKGROUND OF THE INVENTION

Conventional automatic cleaning appliances, such as washing machines, dishwashers, and the like, involve the mixing of a wash aid with water to create a wash liquid to facilitate the cleaning process. These wash aids may include detergents, water softeners, fabric softeners, whitening agents, brightening agents, in-wash stain removers, color safe bleaches, peroxygen bleaches and the like. One dispensing method is for the appropriate quantity of wash aid to be added to the cleaning appliance by an operator prior to the initiation of the laundering cycle. The operator places the wash aid in a dispenser, and the wash aid is introduced into the water at a preselected step in the cleaning cycle. The effectiveness of the wash aid is dependent, at least in part, on the quantity of wash aid dispensed. Thus, accurate measuring and dispensing of the wash aid is very desirable.

Certain wash aids, particularly laundry detergents, are increasingly supplied to the public in higher concentrations, such as twice or three times the concentration of a traditional laundry detergent. Thus, for example, if a traditional laundry detergent has a base concentration identified as "1×," a detergent having twice the concentration or triple the concentration can be identified as "2×" or "3×", respectively. Because these detergents are more highly concentrated, a smaller quantity of higher-concentration detergent is required to provide the same cleaning effectiveness as a 1× detergent.

The more highly concentrated wash aids have created a dispensing problem. Current dispensing systems are designed for wash aids of a known and standard concentration, such as the 1× detergent concentration. If a wash aid of a greater concentration is used, the dispensing system is dependent on the user to place the appropriate amount of wash aid in the dispenser. Unfortunately, reliance on the user provides a source of dispensing errors, the most likely of which is the filling of the dispensing system with too much of the higher concentration wash aid.

Conventional cleaning appliances, such as washing machines and dishwashers, require a specific amount of detergent in order to optimize cleaning and minimize the generation of excess suds, which can be detrimental to the cleaning process and certain components, particularly pumps. High concentrations of detergent can also be damaging to certain fabrics. The quantity of detergent required will be dependent on the concentration of the detergent. Thus, for example, if too large a quantity of a high-concentration detergent is dispensed, excessive sudsing can occur, or fabrics can be damaged. Conversely, if too low a quantity of a low-concentration detergent is used, soil removal from the laundered items can be less effective.

SUMMARY OF THE INVENTION

A treatment aid dispensing apparatus for an automatic treatment appliance includes a bulk treatment aid dispenser, a sensor coupled with the bulk treatment aid dispenser, and a controller coupled with the sensor and the bulk treatment aid dispenser. A quantity of an undiluted treatment aid can be determined by the controller prior to dispensing from the bulk treatment aid dispenser based upon information from the sensor indicative of a sensed concentration of the undiluted treatment aid. The controller can process the information from the sensor and control the operation of the bulk treatment aid dispenser.

BRIEF DESCRIPTION OF THE DRAWINGS

In the drawings:

FIG. 3 is a table of the relationship between surfactant concentration and refractive index according to one embodiment of the invention.

DESCRIPTION OF AN EMBODIMENT OF THE INVENTION

Figure 1:
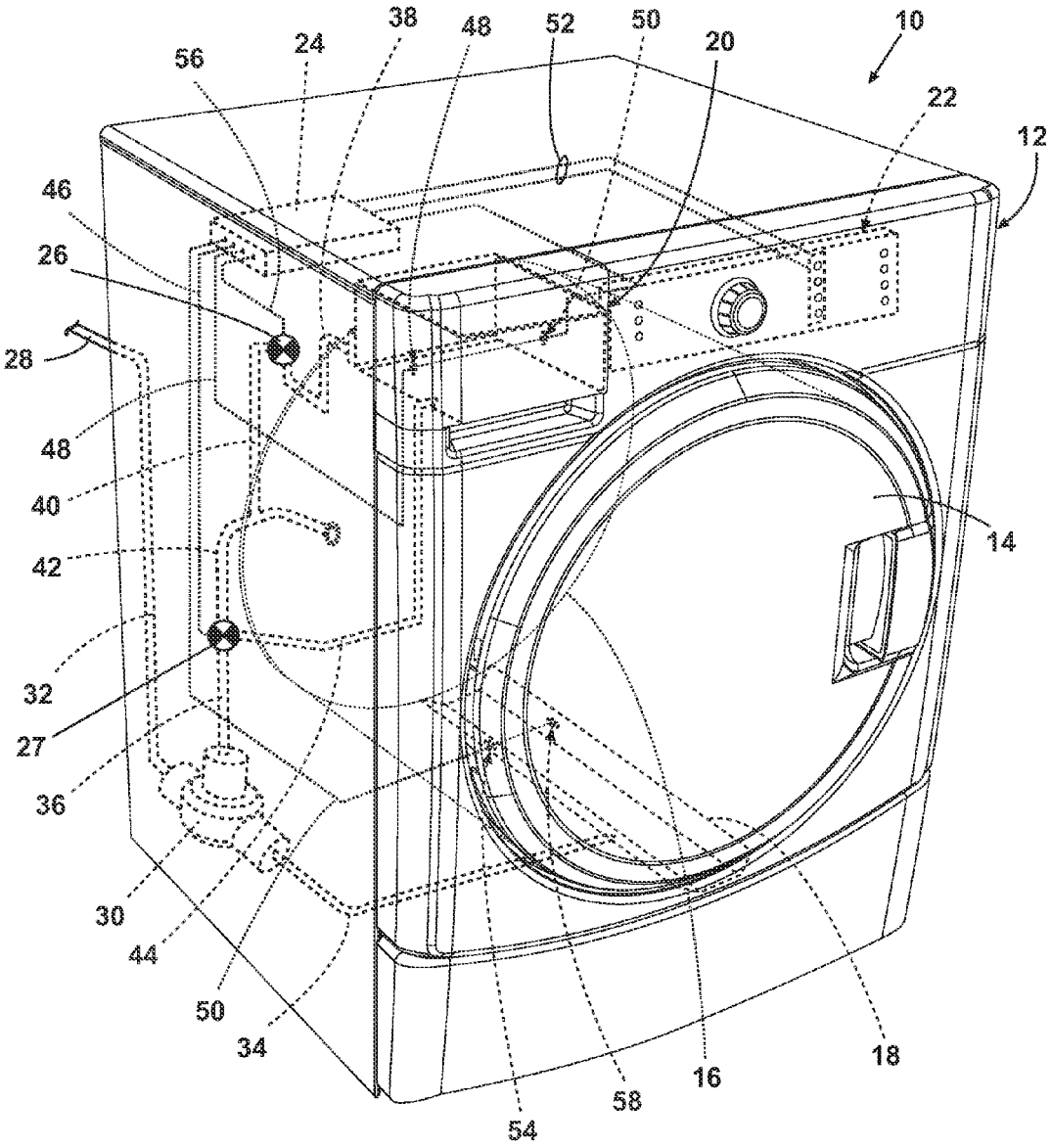
FIG. 1 is a perspective, partly schematic, view of a first embodiment of the invention as an automatic clothes washing machine having at least one concentration sensor, in the form of a refractive index sensor assembly, for determining the concentration of a wash aid.

While the invention will be described in the environment of a clothes washing machine, the invention disclosed herein is suitable for use in transforming one aspect of an article to another utilizing a treatment aid in any treatment appliance. Examples of such a treatment appliance may include clothes washing machines, clothes dryers, combination clothes washers/dryers, dishwashing machines, fabric fresheners, trash compactors, and the like. Examples of treatment aids may include detergents for use in clothes washing machines and dishwashers, antistatic additives for use in dryers, fragrances for use in fabric fresheners, and deodorizers/disinfectants for use in trash compactors. "Transforming one aspect of an article to another" may include removing soil from clothing or kitchen utensils, drying clothing or kitchen utensils, removing odors and wrinkles from clothing and other fabrics, and deodorizing and disinfecting trash compactors during use. Thus, the description and drawings of the clothes washing machine should not be considered as limiting, except as otherwise stated herein.

Clothes washing machines may be typically categorized as either a vertical axis washing machine or a horizontal axis washing machine. While there are situations where technology may not be transferable between horizontal axis machines and vertical axis machines, the invention disclosed herein may be suitable for use in both horizontal axis and vertical axis automatic clothes washing machines.

As used herein, the "vertical axis" washing machine refers to a washing machine having a rotatable drum that rotates about a generally vertical axis relative to a surface that supports the washing machine. However, the rotational axis need not be vertical. The drum may rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be horizontal. The drum may rotate about an axis inclined relative to the horizontal axis, with fifteen degrees of inclination being one example of inclination.

Vertical axis and horizontal axis machines are often differentiated by the manner in which they impart mechanical energy to the fabric articles. In vertical axis machines, a fabric moving element, e.g. impeller and/or agitator, moves within a drum to impart mechanical energy directly to the clothes or indirectly through wash liquid in the drum. In horizontal axis machines, mechanical energy may typically be imparted to the clothes by the tumbling action formed by the repeated lifting and dropping of the clothes, which may be typically implemented by the rotating drum. A horizontal axis machine, however, is not precluded from having a separate fabric moving element. The invention disclosed herein may be suitable for use in both horizontal axis and vertical axis automatic clothes washing machines. The invention will be illustrated and described, however, in the context of a horizontal axis automatic clothes washing machine.

Known horizontal axis washing machines are typically divided into one of two types based upon their washing action and water usage. The first type is known as a "tumble wash;" the second type is known as a "recirculating wash."

In the tumble wash, wash liquid is added to the tub so that the bottom of the drum and items resting in the bottom of the drum, are at least partially submerged. As the drum rotates, items are lifted up and dropped into the wash liquid in the bottom of the drum. This action imparts mechanical energy to the items to facilitate their cleaning.

In the recirculating wash, the level of wash liquid typically does not extend into the drum, although in some embodiments it could. Rather, the drum and items to be laundered are rotated while wash liquid is recirculated from the sump and sprayed on the items. The force of the liquid sprayed through the items facilitates their cleaning. An advantage of the recirculating wash is that less water may be used.

In the description that follows, a specific functionality relating exclusively to either the tumble wash or the recirculating wash will be indicated. Otherwise, the functionality will be considered equally applicable to both washes.

Referring now to the drawings, and in particular to FIG. 1, a first embodiment of the invention is illustrated as a horizontal axis automatic clothes washing machine 10. The clothes washing machine 10 may include a cabinet 12 enclosing components typically found in a conventional washing machine, such as motors, pumps, fluid lines, controls, sensors, transducers, and the like. Such components will not be described further herein except as necessary for a complete understanding of the invention.

A door 14 may be provided for access to the interior a tub 16 and drum 17 (FIG. 2) suspended in the interior of the cabinet 12. The interior of the drum 17 defines a treatment chamber, hereinafter referred to relative to a clothes washing machine as a wash chamber, in which the laundry items are placed for cleaning. The tub 16 may be associated with a sump 18 for carrying a liquid used during a laundering cycle.

Referring back to FIG. 1, the cabinet 12 may also enclose a dispenser drawer 20 for dispensing liquid treatment aids, hereinafter referred to relative to a clothes washing machine as wash aids, during a treatment or laundering cycle. Such wash aids may include laundry detergents, fabric softeners, bleach, in-wash stain removers, color-safe bleaches, peroxygen bleaches, and the like. The dispenser drawer 20 may be configured for one or both of a single use dispenser having one or more cups or compartments, each of which may hold a different wash aid that may be flushed out at selected intervals during the laundry cycle, or a multiple use dispenser. A single use dispenser is typically replenished with a preselected volume of one or more selected wash aids before each laundry cycle. A multiple use dispenser, also referred to as a bulk wash aid dispenser, typically holds enough wash aid for multiple cycles. While the dispenser drawer may be configured for one or both of a single use dispenser or a bulk wash aid dispenser, the embodiment of the invention as described focuses on a bulk wash aid dispenser.

A suitable dispenser for dispensing as both a single wash aid dispenser and a bulk wash aid dispenser may be found in concurrently-filed, commonly-owned U.S. patent application Ser. No. 12/165,712, filed Jul. 1, 2008, entitled "A Household Cleaning Appliance With A Dispensing System Operable Between A Single Use Dispensing System And A Bulk Dispensing System," which is incorporated herein by reference in its entirety.

The cabinet 12 may include a user interface 22 having operational controls such as dials, lights, switches, and displays enabling a user to input commands to a controller 24 and receive information about a specific laundering cycle. The user interface 22 may be electrically coupled with the controller 24 through user interface leads 52. The controller 24 may control a variety of operations, such as controlling a selected laundering cycle, controlling a selected modification to a selected laundering cycle, controlling pumps, motors, and sensors, terminating a laundering cycle in response to an error condition, or causing an audio or visual signal to be broadcast.

Figure 2:
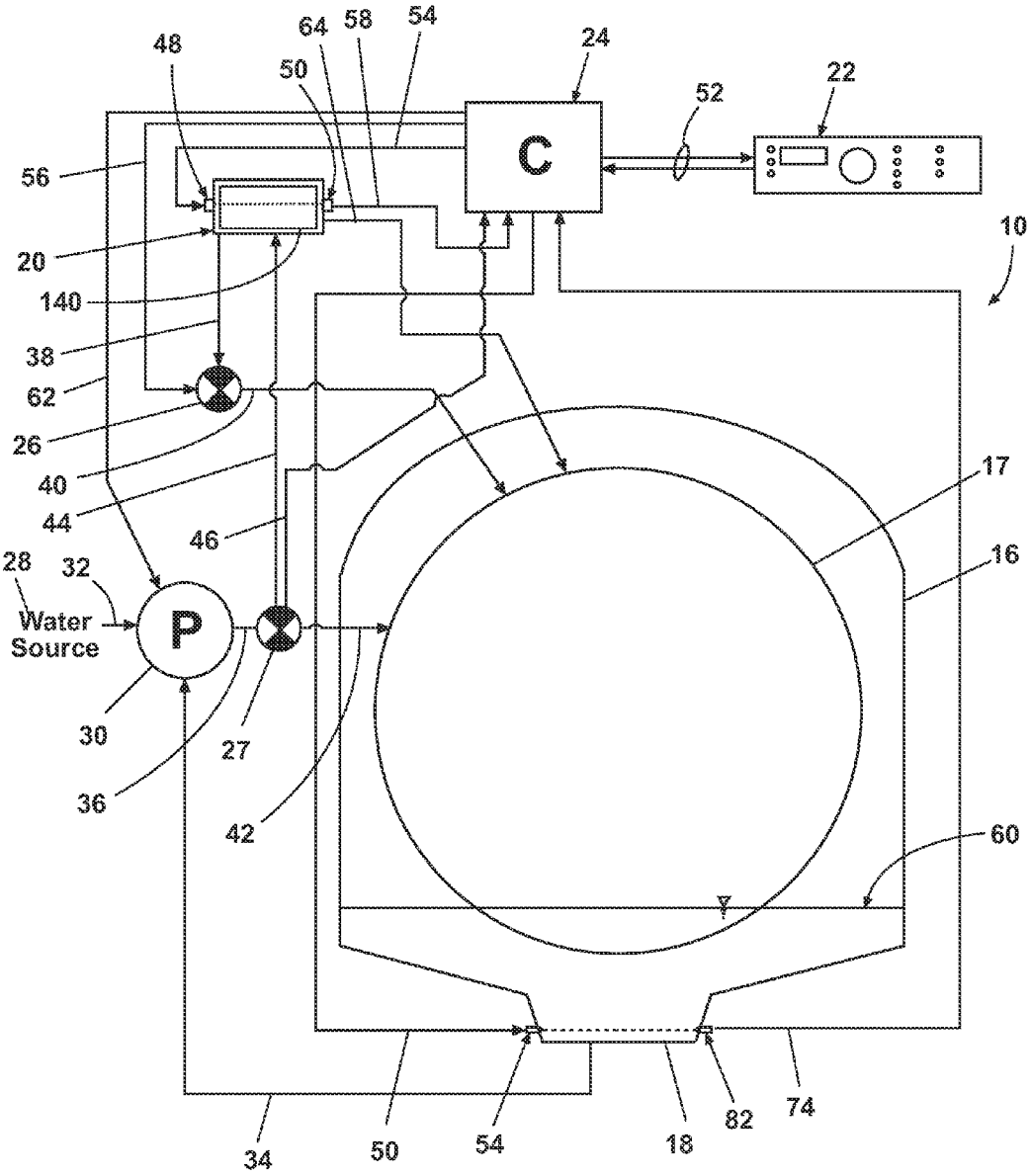
FIG. 2 is a schematic view of the automatic clothes washing machine illustrated in FIG. 1.

Referring to FIG. 2, the cabinet 12 may also enclose a pump 30 fluidly coupled with a water supply 28, and a pair of valves 26, 27. The single pump 30 is illustrated for introducing fresh water from the water supply 28 into the tub 16 or the dispenser drawer 20. The fluid coupling of the pump 30 to the tub 16 may be directly with the sump 18 through a sump line 34. The pump 30 is also illustrated as fluidly coupled with a flush valve 27 through a pump output line 36. The flush valve 27 may be fluidly coupled through a recirculating line 42 with the tub 16 for recirculating wash liquid from the sump 18 to the tub 16. The flush valve 27 may also be fluidly coupled with the dispenser drawer 20 for delivering fresh water from the pump 30 to the dispenser drawer 20.

If the pressure of the water supply is great enough, the pump 30 may not be necessary and may easily be replaced by a valve or other type of water diverter. This is true even if recirculation is still desired. In such a case, a more simple pump will be used just for the recirculation, with the valve or diverter controlling the supply of water to the tub 16 or dispenser drawer 20.

The dispenser drawer 20 may also be fluidly coupled through a dispensing line 38 with the dispenser valve 26, which may in turn be fluidly coupled with the tub 16 through a dispensing line 40. Fresh water may be delivered from the pump 30 through the flush valve 27 into the dispenser drawer 20 for flushing a wash aid from the dispenser drawer 20 through the dispensing line 38, the dispensing valve 26, and the dispensing line 40 into the tub 16. The dispensing valve 26 may be electrically coupled with the controller 24 through a dispenser valve control lead 56. The flush valve 27 may be electrically coupled with the controller 24 through a flush valve control lead 46. The controller 24 may control the operation of the valves 26, 27 in response to instructions received from the user interface 20 as a result of selections made by the user, such as laundering cycle, water temperature, spin speed, extra rinse, and the like. The dispenser valve 26 is illustrated as external to the dispenser drawer 20. Alternatively, it is within the scope of the invention for the dispenser valve 26 to be incorporated into the dispenser drawer 20 or elsewhere within the cabinet 12.

The dispensing system need not comprise a drawer. The individual wash aid compartments may be accessible through a door or movable panel in the cabinet, which may be more appropriate for a top-loading or vertical axis washing machine.

The first embodiment of the washing machine 10 is only one example of a washing machine configuration. It will be recognized that several pumps may be utilized for selected functions, a fewer or greater number of valves may be utilized depending upon the selected fluid line configuration and degree of control desired, and control leads may be incorporated into the device based upon the components for which control by the controller 24 may be desired.

A concentration sensor may be provided in the bulk wash aid dispenser for determining the concentration of the wash aid. While any suitable concentration sensor may be used, as illustrated the concentration sensor is a refractive index sensor including a light beam transmitter 48 and a dispenser receiver 50. The dispenser receiver 50 may be electrically coupled with the controller 24 through a dispenser receiver output lead 58, and the light beam transmitter 48 may be electrically coupled with the controller 24 through a transmitter input lead 54 for control of a light beam projected from the light beam transmitter 48 through the wash aid to the dispenser receiver 50. A beam of light may be projected through the wash aid from the transmitter 48 onto the receiver 50, which generates a signal indicative of the concentration of the wash aid, which may be delivered to the controller 24 through the dispenser receiver output lead 58. A suitable sensor includes a refractive index sensor, such as a Model DGWS1 liquid refractive index sensor, available from Thorlabs of Newton, N.J.

DESCRIPTION OF EMBODIMENTS OF THE INVENTION

Other types of sensors may be used to determine the concentration of a wash aid. Examples of such sensors include a resistivity sensor having a pair of electrodes in contact with the wash liquid, a pH sensor, an oxidation/reduction sensor, a chemical sensor, and the like, capable of generating a signal proportional to the concentration of the wash aid.

The use of the refractive index sensor assembly enables precise control of the volume of wash aid dispensed. For example, if a selected laundering cycle and wash load size correspond with a predetermined volume of wash aid having a selected concentration to provide optimal laundering, the refractive index sensor assembly may determine the concentration of the wash aid, and the controller 24 may control the dispensing valve 26 to dispense the predetermined volume of wash aid for the selected laundering cycle and wash load size. Alternatively, if the concentration of the wash aid may be input by a user through the user interface 22 into the controller 24, the refractive index sensor assembly may confirm that the concentration of the wash aid in the bulk wash aid dispenser is indeed the concentration entered by the user. If an adjustment in volume is necessary to account for a difference in concentration from that input into the controller 24, the controller 24 may control the dispensing valve 26 to dispense the appropriate volume of wash aid.

The refractive index sensor assembly may be used in a similar manner to control the volume of wash aid dispensed from a large bulk wash aid container (not shown). The bulk container may hold a quantity of wash aid sufficient for a relatively large number of laundering cycles. The large container may not be utilized with a dispenser drawer, but may be fluidly coupled with the washing machine 10 through a dispenser fitting incorporated into the washing machine 10, in which the large container may be seated. The large container may be coupled with the washing machine 10 through a liquid-tight coupling (not shown), such as a quick-connect coupling assembly. The coupling may be fluidly connected to the valve 26, or to a dedicated dispensing valve (not shown) incorporated into the dispenser fitting.

The volume of wash aid in the bulk wash aid dispenser may be determined from the incorporation of a liquid height sensor into the dispenser. Such sensors are known to those of ordinary skill in the art. Thus, the control of the operation of the washing machine 10 may be correlated to the height, and consequently the volume, and concentration of the wash aid.

After introducing a laundry detergent having a selected concentration into the bulk wash aid dispenser and closing the dispenser drawer 20, a user may select a laundry cycle, and may adjust options such as water temperature, spin speed, and the like. After starting the selected laundry cycle, the concentration of the laundry detergent in the dispenser may be determined as described above. The controller 24 may then determine the quantity of laundry detergent to be dispensed from the dispenser based upon the laundry cycle, the weight of the laundry load, and other factors that may affect detergent volume, such as water temperature.

Alternatively, if the user has selected, for example, a 2× detergent on the user interface 22, the controller 24 may confirm that the proper concentration detergent, i.e. a 2× detergent, is present, and proceed with the laundry cycle. If, however, the user has selected, for example, a 1× detergent on the user interface 22, but has introduced 4× detergent into the dispenser, the controller 24 may determine what volume of 4× detergent should be dispensed for the selected laundry cycle, load weight, and any other factors. Alternatively, the controller 24 may terminate the laundry cycle, cause an audio or visual warning signal to be broadcast, or a combination of termination and a warning signal.

A refractive index sensor assembly utilized in a washing machine having a bulk wash aid dispenser may lead to more accurate control of the dispensing of the wash aid, since the volume of wash aid to be dispensed can be accurately determined by the controller 24 based upon the inputs from the refractive index sensor assembly, and the controller 24 can precisely control the volume of wash aid dispensed from the bulk wash aid dispenser regardless of the concentration.

FIG. 3 is a table illustrating the refractive index for different concentrations of detergent from different manufactures. It can be seen from the tabular data that there is a general correlation between the percentage of surfactant and the refractive index for a detergent. The refractive index tends to increase as the percentage of surfactant increases. This general correlation is strong enough that the refractive index may be used to determine between classes of concentrations, such as 1× and 3× detergents. Determining the refractive index of a surfactant is not the only means of identifying the concentration of the detergent. The refractive index of other detergent components, such as builders, emulsifiers, soil suspending agents, alkaline builders, optical brighteners, unit weights, and the like, may be utilized to determine the concentration of such components. While the general correlation between refractive index and percent surfactant is sufficient to determine between classes, there is variation in the refractive index within a given concentration range, which is not solely attributable to the variations of the percent surfactant. These variations are thought to be attributable to other ingredients in the detergent. These variations are also partly attributable to the fact that not all detergents in a given class, i.e. 1×, 3×, etc., have the same identical percentage of surfactant.

It has been noted that each detergent has a unique refractive index. In this way, the refractive index may be used as an identifier for a specific detergent. The refractive index may be used as "fingerprint" to identify a specific detergent regardless of its surfactant concentration. A database or table of information may be created showing the refractive index for each type of detergent. This database may be used by the controller to look up the specific detergent based on the sensed refractive index and determine the corresponding concentration.

Thus, the refractive index information may be used in at least two ways, separately or in combination, to determine the concentration of the detergent and to use that information to control the dispensing of the detergent. The first way is to use the refractive index to make a general determination regarding the class of detergent (1×, 2×, 3×, etc.). The general class determination is useful in making general distinctions, but it may not give specific information about a particular detergent's concentration. The second way is to use the refractive index to identify the detergent and look up the corresponding concentration. The look up method is useful in that the exact concentration values may be determined. For example, an advertised 1× detergent may actually have a 1.2× concentration or a 0.8× concentration.

The controller 24 can implement a technique to determine the surfactant concentration from a sensed refractive index, such as direct lookup, a comparison to a reference value, a linear regression analysis, or interpolation between stored values of refractive index greater than and less than the sensed refractive index. One implementation of this method would be to first use the refractive index to identify the detergent as this will provide the most accurate results. That is, the controller will use an appropriate method to find a match for the sensed refractive index value. The methodology may not require an exact match, but may look for a range or close fit. If a match is not found, then the refractive index may be used to make a general class determination.

Figure 4:
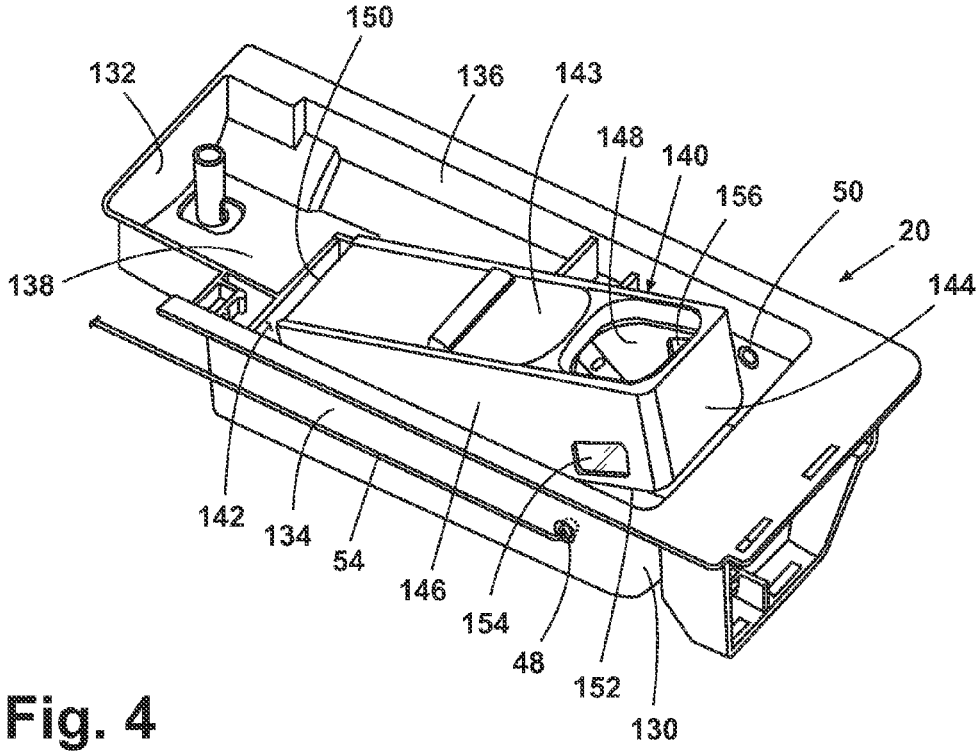
FIG. 4 is a perspective view of a first example of a wash aid dispenser drawer according to one embodiment of the invention, including at least one refractive index sensor assembly for sensing the concentration of a wash aid contained therein.

FIG. 4 illustrates in greater detail an embodiment of the dispenser comprising the dispenser drawer 20 suitable for use with the automatic clothes washing machine 10. The dispenser drawer 20 is illustrated as a generally open-top box-like structure having a front wall 130, a rear wall 132, a pair of sidewalls 134, 136, and a bottom wall 138. The dispenser drawer 20 may be configured with interior walls defining a cartridge cavity 142 for receipt of a bulk dispenser cartridge 140. The dispenser cartridge 140 may contain a quantity of a wash aid, such as a laundry detergent, sealed therein behind a slidable door 143 (shown open in FIG. 4) and sufficient for several laundering cycles, for example, 8-10 laundering cycles. The use of the dispenser cartridge 140 may eliminate the need for a user to measure out a selected volume of wash aid for each laundering cycle.

The dispenser cartridge 140 may be a generally rectilinear, box-like container sized to be received within the cartridge cavity 142 of the dispenser drawer 20. The cartridge may have a front wall 144, a pair of parallel side walls 146, 148, a rear wall 150, a top wall 151 with the slidable door 143, and a bottom wall 152 defining a cartridge cavity in which the wash aid may be contained. The slidable door 143 may be formed in the top wall 151 to provide for ready refilling of the cartridge 140. Each side wall 146, 148 may be provided with a sensor window 154, 156, respectively, the sensor windows 154, 156 being aligned for the transmission of a refractive index sensor light beam through the wash aid.

Although the bulk dispenser cartridge has been described as a rectangular box-like container, the bulk dispenser cartridge may be any type of removable container configured to store multiple doses of a treating chemistry. The cartridge may have any shape and size that is receivable within the dispenser. The removable cartridge may be flexible, rigid, expandable, or collapsible. The cartridge may be fabricated of any type of material or combination of materials. Some examples of suitable cartridges are, without limitation, a plastic container, a cardboard container, a coated cardboard container, and a bladder, all of which are capable of being received within the dispenser.

The dispenser drawer 20 may incorporate the transmitter 48 and the sensor 50 therein for projection of a light beam from the transmitter 48 through the windows 154, 156 and the wash aid, to be received by the sensor 50 for determining the refractive index of the wash aid. The dispenser drawer 20 may also be configured with a suitable fluid connector for connecting the dispenser cartridge 140 into a wash aid dispensing line, such as the dispensing line 38 illustrated in FIGS. 1 and 2. The dispenser cartridge 140 may also be fluidly coupled with a valve for controlling the dispensing of a wash aid into the dispensing line, such as the dispensing valve 26 illustrated in FIGS. 1 and 2.

After the dispenser cartridge 140 has been properly installed in the dispenser drawer 20, a selected volume of wash aid may be dispensed from the dispenser cartridge 140 through operation of the dispensing valve 26 under the control of the controller 24. This may be accomplished by the user selecting a volume of wash aid on the user interface 22. Alternatively, this may be accomplished by selecting a laundering cycle on the user interface 22. The refractive index of the wash aid may then be determined, and correlated in the controller 24 to a surfactant concentration, which may then be processed by the controller 24, along with a determination of the size of the load, to automatically dispense the appropriate volume of wash aid.

Figure 5:
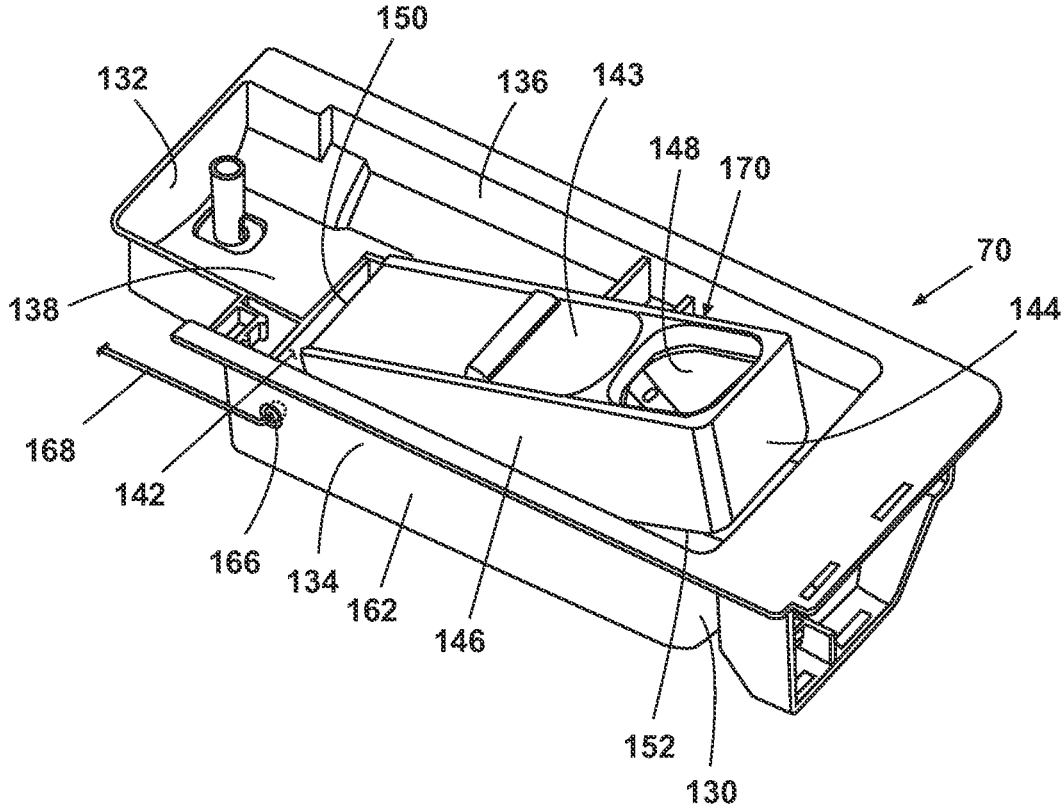
FIG. 5 is a perspective view of a second example of a wash aid dispenser drawer according to one embodiment of the invention, including at least one refractive index sensor assembly for sensing the concentration of a wash aid contained in a bulk dispenser cartridge.

FIG. 5 illustrates an alternate embodiment of a refractive index sensor 210 for incorporation into a wash aid dispenser drawer 70. The dispenser drawer 70 may be similar to the dispenser drawer 20 except that the transmitter 48, the sensor 50, the transmitter input lead 54, and the dispenser sensor output lead 58 are not used. A sensor coupling 166 may be integrated into the side wall 134, and electrically coupled with the controller 24 through a sensor lead 168. The bulk dispenser cartridge 170 differs somewhat from the bulk dispenser cartridge 140 in that the sensor windows 154, 156 are not incorporated into the side walls 146, 148.

Figure 6:
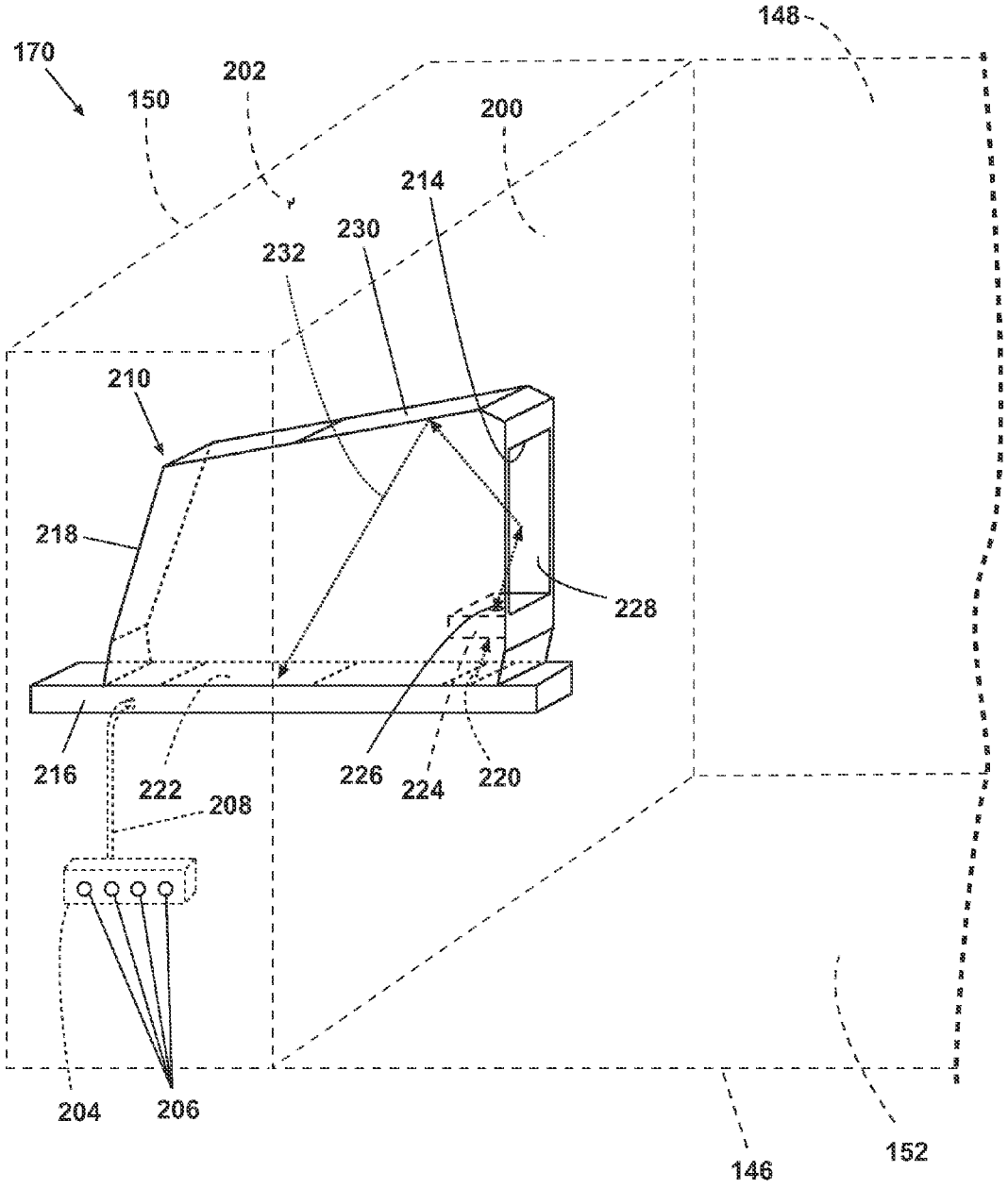
FIG. 6 is an enlarged, partially cutaway view of the wash aid dispenser drawer illustrated in FIG. 5 showing the refractive index sensor assembly.

Referring specifically to FIG. 6, the bulk dispenser cartridge 170 may be provided with an intermediate wall 200 parallel to and spaced internally from the rear wall 150 to define a sensor chamber 202 in which a sensor 210 may be located. The intermediate wall 200 may be provided with a sensor opening 214.

The side wall 146 of the cartridge 170 may incorporate a sensor junction box 204. The sensor junction box 204 may comprise one or more electrical contacts 206 for electrical coupling with complementary electrical contacts (not shown) positioned along the interior of the side wall 134 of the dispenser drawer 70 including part of the sensor coupling 166. The junction box 204 may be coupled with the sensor 210 through a suitable known wire harness 208.

A suitable refractive index sensor 210 may be a Spreeta™-R sensor manufactured by Sensata Technologies of Attleboro, Mass. The sensor 210 includes a base 216 and a housing 218. The housing may be fabricated of a clear material, such as a plastic. The housing 218 includes a glass sensing interface 228 and a reflector 230. The base 216 includes a light source 220 and a photodiode array 222. The light source 220 may comprise one or more light emitting diodes (LEDs) configured to focus light at an angle onto the sensing interface 228. A focusing apparatus 224 may be positioned above the light source 220 and may comprise an aperture 226 for focusing a light beam 232 onto the sensing interface 228. The refractive index sensor 210 may be mounted in the wash aid dispenser drawer 20 so that the sensing interface 228 may be in registry with the sensor opening 214 and can contact the wash aid.

The sensor 210 is based on the optical phenomena of surface plasmon resonance, which occurs when light interacts with a free electron material. In operation, the light from the light source 220 reflects internally off the liquid-glass interface between the sensing interface 228 and the wash aid. The light then reflects off the mirror 230 and onto the photodiode array 222. Depending on the refractive index of the liquid, light striking the surface above a certain angle will be transmitted through the liquid-glass interface instead of being internally reflected. This angle is called the critical angle. This phenomenon results in a dark area or shadow-line on the photodiode array. The location of the shadow-line is indicative of the refractive index. As the refractive index changes, the critical angle also changes and is sensed as a new shadow-line location.

When the cartridge 170 is inserted into the dispenser drawer 70, the junction box 204 may be coupled with the sensor coupling 166, thereby providing communication between the sensor 210 and the controller 24. Data from the sensor 210 corresponding to the refractive index, and thus the concentration, of the wash aid can be delivered to the controller 24 for further processing and control of the dispensing of the wash aid from the bulk dispenser cartridge 170.

The refractive index sensor 210 can also be mounted in a similar manner in a reservoir (not shown) downstream of and fluidly coupled with the dispenser drawer 70. In such a case, a quantity of wash aid can be delivered from the cartridge 170 to the reservoir, and the concentration of the wash aid determined as described above. The controller 24 will then determine the appropriate quantity of wash aid to be dispensed. The advantage of such a configuration is that a single refractive index sensor can be mounted permanently in the dispenser drawer 70 rather than in a cartridge, thereby reducing the cost of a bulk dispenser cartridge.

In either configuration, the sensing apparatus can be contained entirely on one side of the container holding the wash aid. Additionally, only one window into the wash aid is required, and fewer electrical connections are required.

The washing machine 10 illustrated herein is only one example of a washing machine configuration. Several pumps may be utilized for selected functions, a fewer or greater number of valves may be utilized depending upon the selected fluid line configuration and degree of control desired, and control leads may be incorporated into the washing machine 10 based upon the components for which control by the controller 24 may be desired.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A treatment aid dispensing apparatus for an automatic treatment appliance, the automatic treatment appliance having a treatment chamber, and optionally a water supply fluidly coupled with the treatment chamber, the apparatus comprising:

a bulk treatment aid dispenser fluidly coupled with the treatment chamber and operable to dispense a selected volume of undiluted treatment aid into the treatment chamber;

a sensor coupled with the bulk treatment aid dispenser for outputting information indicative of a sensed concentration of the undiluted treatment aid; and a controller coupled with the sensor and the bulk treatment aid dispenser for processing information received from the sensor and controlling the operation of the bulk treatment aid dispenser;

wherein a quantity of the undiluted treatment aid can be determined by the controller prior to dispensing from the bulk treatment aid dispenser into the treatment chamber based upon the sensed concentration of the undiluted treatment aid.

2. The treatment aid dispensing apparatus in accordance with claim 1 wherein the sensor comprises a refractive index sensor.

3. The treatment aid dispensing apparatus in accordance with claim 1 wherein the bulk treatment aid dispenser further comprises a bulk treatment aid dispenser cartridge for fluid coupling with the bulk treatment aid dispenser, the bulk treatment aid dispenser cartridge containing a quantity of an undiluted treatment aid.

4. The treatment aid dispensing apparatus in accordance with claim 3 wherein the concentration of the undiluted treatment aid is sensed when the undiluted treatment aid is in the bulk treatment aid dispenser cartridge.

5. The treatment aid dispensing apparatus in accordance with claim 4 wherein the sensor comprises a refractive index sensor.

6. The treatment aid dispensing apparatus in accordance with claim 3 wherein the concentration of the undiluted treatment aid is sensed when the undiluted treatment aid is in the bulk treatment aid dispenser cartridge.

7. The treatment aid dispensing apparatus in accordance with claim 1 wherein sensing concentration of the undiluted treatment aid comprises sensing at least one of an electrical conductivity, pH, oxidation/reduction potential, and chemical composition of the undiluted treatment aid.

8. The treatment aid dispensing apparatus in accordance with claim 1 wherein the bulk treatment aid dispenser comprises a dispenser drawer movable between an open position and a closed position.

9. The treatment aid dispensing apparatus in accordance with claim 1, further comprising the water supply being fluidly coupled to the bulk treatment aid dispenser such that the sensed undiluted treatment aid is flushed into the treatment chamber by water from the water supply.

10. The treatment aid dispensing apparatus in accordance with claim 1 wherein the undiluted treatment aid comprises at least one of a detergent, a water softener, a fabric softener, an anti-sudsing agent, a fabric whitening agent, a fabric brightening agent, an anti-spotting agent, a fragrance agent, a deodorizing agent, and a disinfectant.

11. The treatment aid dispensing apparatus in accordance with claim 1 wherein the automatic treatment appliance comprises one of a clothes washing machine, clothes dryer, combination clothes washer/dryer, dishwashing machine, fabric freshener, and trash compactor.

* * * * *